US009885989B2

(12) United States Patent
Tsuno

(10) Patent No.: US 9,885,989 B2
(45) Date of Patent: Feb. 6, 2018

(54) IMAGE FORMING APPARATUS FOR CONTROLLING A COLOR DENSITY OF AN IMAGE ON A CONTINOUS RECORDING MEDIUM

(71) Applicant: Oki Data Corporation, Tokyo (JP)

(72) Inventor: Takahiro Tsuno, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/215,569

(22) Filed: Jul. 20, 2016

(65) Prior Publication Data

US 2017/0060035 A1 Mar. 2, 2017

(30) Foreign Application Priority Data

Aug. 28, 2015 (JP) ..... 2015-169225

(51) Int. Cl.
*G03G 15/00* (2006.01)

(52) U.S. Cl.
CPC ..... *G03G 15/5058* (2013.01); *G03G 15/652* (2013.01); *G03G 2215/00059* (2013.01); *G03G 2215/00455* (2013.01)

(58) Field of Classification Search
CPC ..... G03G 15/5058; G03G 15/6517; G03G 15/652; G03G 2215/00059; G03G 2215/00455
USPC ..... 399/49, 72, 384
See application file for complete search history.

(56) References Cited

U.S. PATENT DOCUMENTS 8,891,116 B2 * 11/2014 Dorfner ..... G03G 15/5062 358/1.15
2008/0044192 A1 * 2/2008 Yagawara ..... G03G 15/5058 399/49
2008/0317486 A1 * 12/2008 Monma ..... G03G 15/0131 399/45
2009/0208231 A1 * 8/2009 Izawa ..... G03G 15/105 399/49
2012/0189332 A1 7/2012 Fukao
2015/0168902 A1 * 6/2015 Sasami ..... G03G 15/5054 399/72

(Continued)

FOREIGN PATENT DOCUMENTS

EP 2395401 A1 12/2011
JP 2001201906 A * 7/2001

(Continued)

*Primary Examiner* — Robert Beatty
(74) *Attorney, Agent, or Firm* — Rabin & Berdo, P.C.

(57) ABSTRACT

An image forming apparatus includes: an image forming unit for forming successive images and a pattern image with developer on a transfer member, the successive images including a first image and at least one second image subsequent to the first image; a conveying unit for conveying a medium; a transfer unit for transferring the successive images on the transfer member onto the medium; a detector for detecting the pattern image on the transfer member; a controller for causing the image forming unit to form the pattern image between the first image and the at least one second image and form the at least one second image on the transfer member based on the detection of the pattern image by the detector; and a separation unit for separating the transfer member and the medium from each other to prevent the pattern image from being transferred onto the medium.

15 Claims, 10 Drawing Sheets

(56) References Cited

U.S. PATENT DOCUMENTS

| | | | | |
|---|---|---|---|---|
| 2016/0085195 | A1* | 3/2016 | Uchida | G03G 15/6517 399/45 |
| 2016/0124343 | A1* | 5/2016 | Sakurai | G03G 15/105 399/58 |
| 2016/0342113 | A1* | 11/2016 | Sakurai | G03G 15/161 |

FOREIGN PATENT DOCUMENTS

| | | | | |
|---|---|---|---|---|
| JP | 2003063115 | A | * | 3/2003 |
| JP | 2006-227336 | A | | 8/2006 |
| JP | 2008-304868 | A | | 12/2008 |
| JP | 2009-169057 | A | | 7/2009 |
| JP | 2010152197 | A | * | 7/2010 |

* cited by examiner

IMAGE FORMING APPARATUS FOR CONTROLLING A COLOR DENSITY OF AN IMAGE ON A CONTINOUS RECORDING MEDIUM

BACKGROUND OF THE INVENTION

1. Field of the Invention

The present invention relates to an image forming apparatus and is preferably applied to, for example, an electrophotographic image forming apparatus, such as a printer, a facsimile machine, or a copier, having a density correction function.

2. Description of the Related Art

There is a conventional image forming apparatus including: an image forming unit for forming an image with developer, such as toner; a transfer unit for transferring the image (also referred to as the developer image) formed by the image forming unit onto a recording medium, such as a sheet of paper; and a conveying unit including a belt for conveying the recording medium.

The conventional image forming apparatus performs density correction by forming a test pattern (referred to below as the density correction pattern) for density correction on the conveying unit and reading the density correction pattern by a density correction sensor when the image forming apparatus is started or between print jobs (i.e., when no printing is performed).

Japanese Patent Application Publication No. 2006-227336 discloses an image forming apparatus including a conveying member for conveying a recording medium in a conveying direction, the conveying member having a width (a length in a direction across the conveying direction) greater than that of the recording medium; an image forming unit for forming an image on the recording medium; an image forming processor for causing the image forming unit to form a density detection image outside the recording medium on the conveying member; a sensor for detecting the density of the density detection image; and a density correction processor for performing density correction based on the detected density. With this configuration, when the image forming apparatus prints on a long recording medium, such as a recording medium web from a roll of recording medium or a paper web from a roll of paper, it can perform density correction during the printing.

However, the above image forming apparatus forms the density detection image outside the recording medium in the width direction of the recording medium to perform density correction during printing. Thus, the conveying member and image forming unit need to have widths sufficiently greater than the width of the recording medium. This increases the size of the image forming apparatus.

SUMMARY OF THE INVENTION

An aspect of the present invention is intended to provide a small image forming apparatus capable of forming a test pattern during printing.

According to an aspect of the present invention, there is provided an image forming apparatus, including: an image forming unit that forms a plurality of successive images and a test pattern image with developer on a primary transfer member, the plurality of successive images including a first image and at least one second image subsequent to the first image; a conveying unit that conveys a continuous recording medium to bring the continuous recording medium into contact with the primary transfer member; a secondary transfer unit that transfers the plurality of successive images formed on the primary transfer member onto the continuous recording medium in contact with the primary transfer member; a detector that detects the test pattern image formed on the primary transfer member; a controller that causes the image forming unit to form the plurality of successive images in accordance with image data, the controller causing the image forming unit to form the test pattern image between the first image and the at least one second image, the controller causing the image forming unit to form the at least one second image on the primary transfer member based on the detection of the test pattern image by the detector; and a transfer separation unit that separates the primary transfer member and the continuous recording medium from each other and brings the primary transfer member and the continuous recording medium into contact with each other, the transfer separation unit separating the primary transfer member and the continuous recording medium from each other to prevent the test pattern image from being transferred onto the continuous recording medium.

DETAILED DESCRIPTION OF THE INVENTION

An embodiment of the present invention will now be described with reference to the attached drawings.

<1. Configuration of Printing System>

Figure 1:
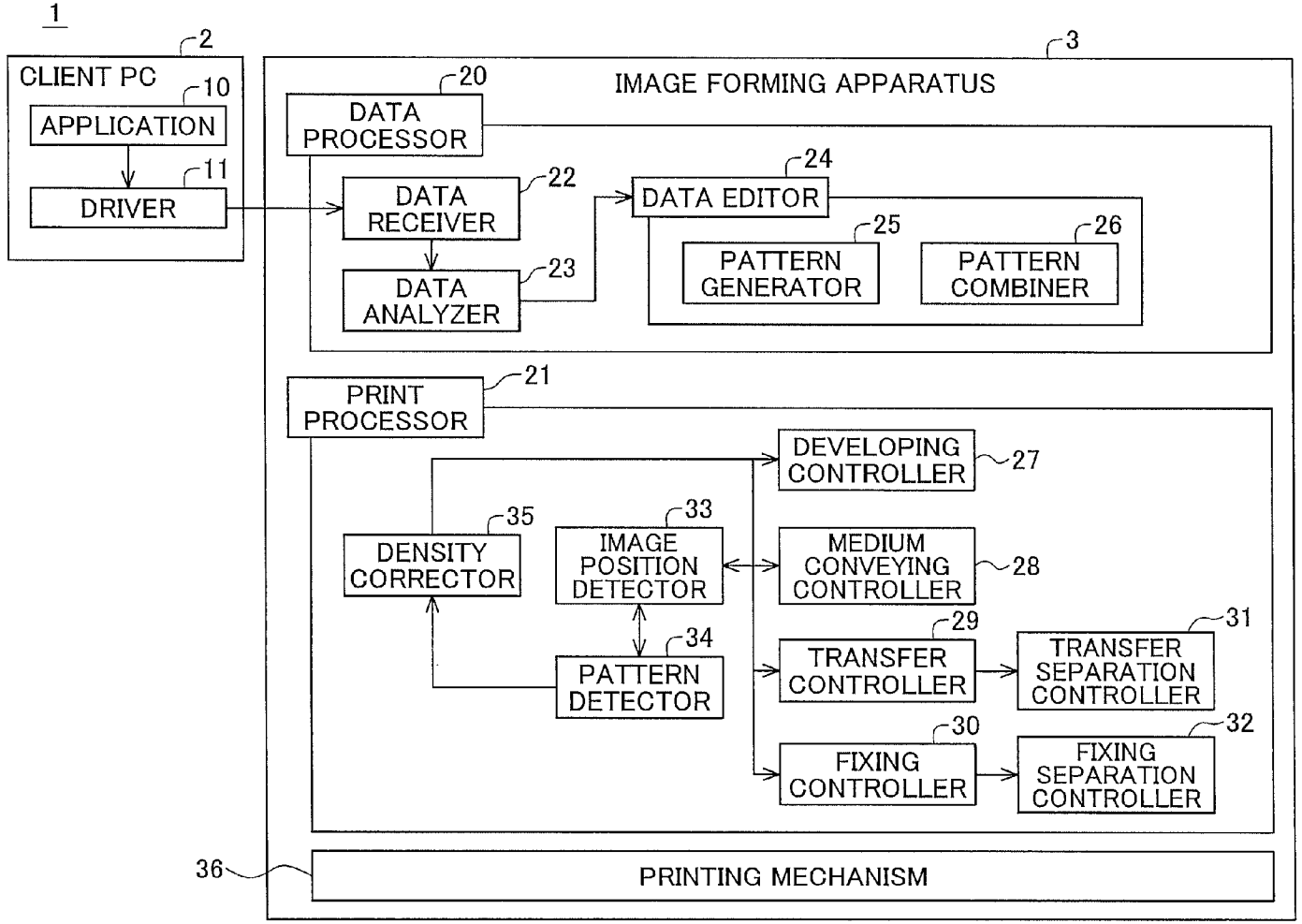
FIG. 1 is a block diagram illustrating a configuration of a printing system.

FIG. 1 illustrates a functional configuration of a printing system 1 of this embodiment. The printing system 1 includes a client personal computer (PC) 2 and an image forming apparatus 3 connected to the client PC 2 via a network or the like. The client PC2 has an application 10 for generating image data and a driver 11 for giving a print instruction to the image forming apparatus 3, which are installed in the client PC 2.

The driver 11 generates a print job including image data generated by the application 10 and print settings. The print settings include, for example, designation of a sheet size, designation of monochrome/color printing, or the like. The print job is sent from the client PC 2 to the image forming apparatus 3.

The image forming apparatus 3 includes a data processor 20, a print processor 21, and a printing mechanism 36.

Figure 2:
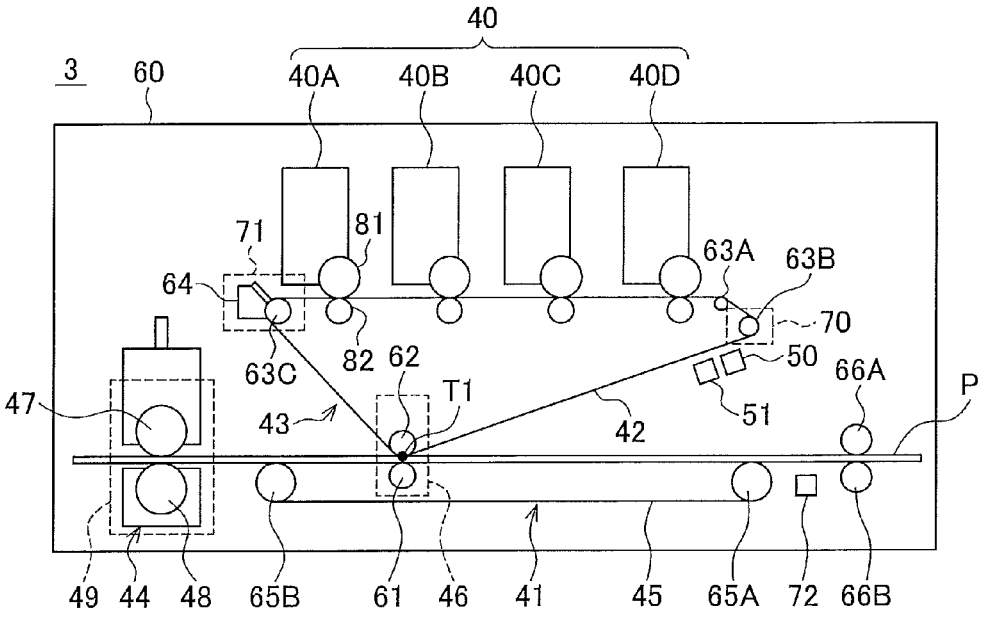
FIG. 2 is a side view illustrating a configuration of a printing mechanism of an image forming apparatus.

FIG. 2 schematically illustrates the printing mechanism 36 of the image forming apparatus 3. In FIG. 2, the printing mechanism 36 includes a developing section 40, a conveying unit 41, an intermediate transfer unit 43, and a fixing unit 44, which are arranged in a housing 60 of the image forming apparatus 3. The developing section 40 includes multiple (e.g., four) developing units 40A, 40B, 40C, and 40D arranged in an upper portion of the housing 60. The four developing units 40A, 40B, 40C, and 40D are units corresponding to, for example, cyan, magenta, yellow, and black, respectively. Each of the developing units 40A, 40B, 40C, and 40D forms a developer image using a developer of the corresponding color and transfers the developer image onto an intermediate transfer belt 42 of the intermediate transfer unit 43. Specifically, each of the developing units 40A, 40B, 40C, and 40D includes a photosensitive drum 81 and a transfer 82, forms a developer image on the photosensitive drum 81 and transfers the developer image by the transfer roller 82 from the photosensitive drum 81 to the intermediate transfer belt 42. The developing units 40A, 40B, 40C, and 40D sequentially transfer developer images onto the intermediate transfer belt 42 in a superposed manner to generate a color image, which is a developer image consisting of the four-color developer images.

The intermediate transfer unit 43 is disposed below the developing section 40. The intermediate transfer unit 43 includes the intermediate transfer belt 42, an intermediate transfer roller 61, a backup roller 62, belt rollers 63A, 63B, and 63C, and a belt cleaner 64.

The intermediate transfer belt 42 is stretched by the backup roller 62 and belt rollers 63A, 63B, and 63C in an inverted triangular shape with its upper side flat and its lower side projecting downward. The intermediate transfer belt 42 has a flat portion on its upper side and a projecting portion on its lower side. The intermediate transfer roller 61 is disposed outside the projecting portion of the intermediate transfer belt 42. The backup roller 62 is disposed inside the projecting portion of the intermediate transfer belt 42. The intermediate transfer roller 61 is disposed facing the backup roller 62. The intermediate transfer roller 61 and backup roller 62 form a nip portion therebetween. The position of the nip portion of the intermediate transfer unit 43 will be referred to as the nip position T1.

The multiple developing units 40A, 40B, 40C and 40D transfer (primary-transfer) developer images onto an outer surface of the flat portion of the intermediate transfer belt 42. The developer images thus transferred onto the intermediate transfer belt 42 are conveyed by the intermediate transfer belt 42 traveling or rotating clockwise in FIG. 2 and transferred (secondary-transferred) onto a recording medium P when the recording medium P passes through the nip portion. The recording medium P is conveyed by the conveying unit 41 to the nip portion as described later.

The belt cleaner 64 is disposed downstream (on the left side in FIG. 2) of the nip portion of the intermediate transfer belt 42 in a conveying direction of the developer images and outside the intermediate transfer belt 42. The belt cleaner 64 is disposed at a predetermined position (near the belt roller 63C located at one end of the flat portion) between the nip portion and the flat portion. The belt cleaner 64 removes developer remaining on the intermediate transfer belt 42.

Further, an image position sensor 50 is disposed upstream (on the right side in FIG. 2) of the nip portion of the intermediate transfer belt 42 in the conveying direction of the developer images and outside the intermediate transfer belt 42. The image position sensor 50 is disposed at a predetermined position (near the belt roller 63B located at the other end of the flat portion) between the nip portion and the flat portion. Further, a density correction sensor 51 is disposed near and downstream of the image position sensor 50.

The conveying unit 41 is disposed below the intermediate transfer unit 43. The conveying unit 41 includes a conveying belt 45 and belt rollers 65A and 65B. The conveying belt 45 is stretched by the belt rollers 65A and 65B in an oval shape with its upper and lower sides flat. The conveying belt 45 travels or rotates counterclockwise in FIG. 2, thereby conveying the recording medium P placed on its upper flat portion. Conveying rollers 66A and 66B are disposed upstream of the conveying belt 45 in a conveying direction (referred to below as the medium conveying direction) of the recording medium P so as to face each other. A direction across or perpendicular to the medium conveying direction will be referred to as a main-scanning direction. A direction parallel or corresponding to the medium conveying direction will be referred to as a sub-scanning direction. The recording medium P is a paper web from a roll of paper. The recording medium P is drawn from a roll of paper contained in a container (not illustrated) and conveyed to the conveying belt 45 by the conveying rollers 66A and 66B or the like.

The intermediate transfer roller 61 of the intermediate transfer unit 43 is disposed on the inside of the upper flat portion of the conveying belt 45. In the nip portion, the intermediate transfer belt 42 and conveying belt 45 are in contact with each other between the intermediate transfer roller 61 and the backup roller 62. The recording medium P passes through the nip portion while sandwiched between the intermediate transfer belt 42 and the conveying belt 45. At this time, the developer images transferred on the intermediate transfer belt 42 are transferred onto the recording medium P.

The fixing unit 44 is disposed downstream of the nip portion of the intermediate transfer unit 43 in the medium conveying direction. The fixing unit 44 includes a fixing belt 47 heated by a heater and a pressure roller 48. The fixing belt 47 and pressure roller 48 are disposed in contact with each other. The fixing unit 44 applies heat and pressure to the recording medium P when the recording medium P passes between the fixing belt 47 and the pressure roller 48, thereby fixing the developer images to the recording medium P. Then, the recording medium P is continuously discharged through an outlet (not illustrated).

Figure 3:
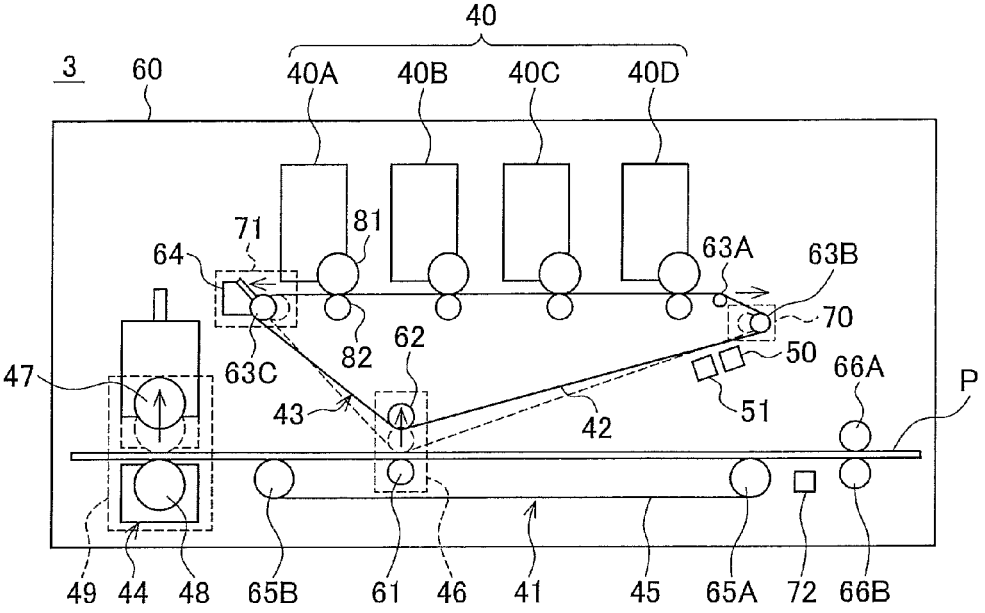
FIG. 3 is a view illustrating operation of a transfer separation mechanism and a fixing separation mechanism.

Further, the image forming apparatus 3 includes a transfer separation mechanism 46 and a fixing separation mechanism 49 in the housing 60. The transfer separation mechanism 46 includes, for example, a solenoid. The transfer separation mechanism 46 moves the backup roller 62 in a direction away from the intermediate transfer roller 61 (or a direction toward the inside of the intermediate transfer belt 42) as illustrated in FIG. 3, thereby separating the intermediate transfer belt 42 and conveying belt 45 from each other.

If only the backup roller 62 is moved toward the inside of the intermediate transfer belt 42, the tension of the intermediate transfer belt 42 decreases. Thus, corresponding to the movement of the backup roller 62 in the direction toward the inside of the intermediate transfer belt 42, the image forming apparatus 3 moves the belt rollers 63B and 63C, which stretch the intermediate transfer belt 42, in directions toward the outside of the intermediate transfer belt 42 by roller slide units 70 and 71, respectively. The roller slide units 70 and 71 each include, for example, a solenoid. Thereby, the tension of the intermediate transfer belt 42 can be kept constant. Since the belt cleaner 64 is disposed near the belt roller 63C, the roller slide unit 71 slides or moves the belt cleaner 64 together with the belt roller 63C, for example.

The transfer separation mechanism 46 and roller slide units 70 and 71 respectively return the backup roller 62 and belt rollers 63B and 63C to their original positions, thereby bringing the intermediate transfer belt 42 and conveying belt 45 into contact with each other again.

The transfer separation mechanism 46 can move the backup roller 62 in the direction away from the intermediate transfer roller 61 when the recording medium P has reached the nip portion, thereby separating the intermediate transfer belt 42 from the recording medium P.

The fixing separation mechanism 49 includes, for example, a solenoid. The fixing separation mechanism 49 moves the fixing belt 47 in a direction away from the pressure roller 48, thereby separating the fixing belt 47 and pressure roller 48 from each other, as illustrated in FIG. 3. Also, the fixing separation mechanism 49 returns the fixing belt 47 to its original position, thereby bringing the fixing belt 47 and pressure roller 48 into contact with each other again. The fixing separation mechanism 49 can move the fixing belt 47 in the direction away from the pressure roller 48 when the recording medium P has reached the fixing unit 44, thereby separating the fixing belt 47 from a print surface, which is a surface on which developer images are transferred, of the recording medium P and stopping application of heat and pressure to the print surface of the recording medium P.

The image forming apparatus 3 further includes, in the housing 60, a medium sensor 72 for detecting the recording medium P. The medium sensor 72 is disposed between the belt roller 65A of the conveying unit 41 and the conveying roller 66B, for example.

Referring back to FIG. 1, the data processor 20 includes a data receiver 22, a data analyzer 23, and a data editor 24. The data receiver 22 receives a print job from the client PC 2.

Figure 4:
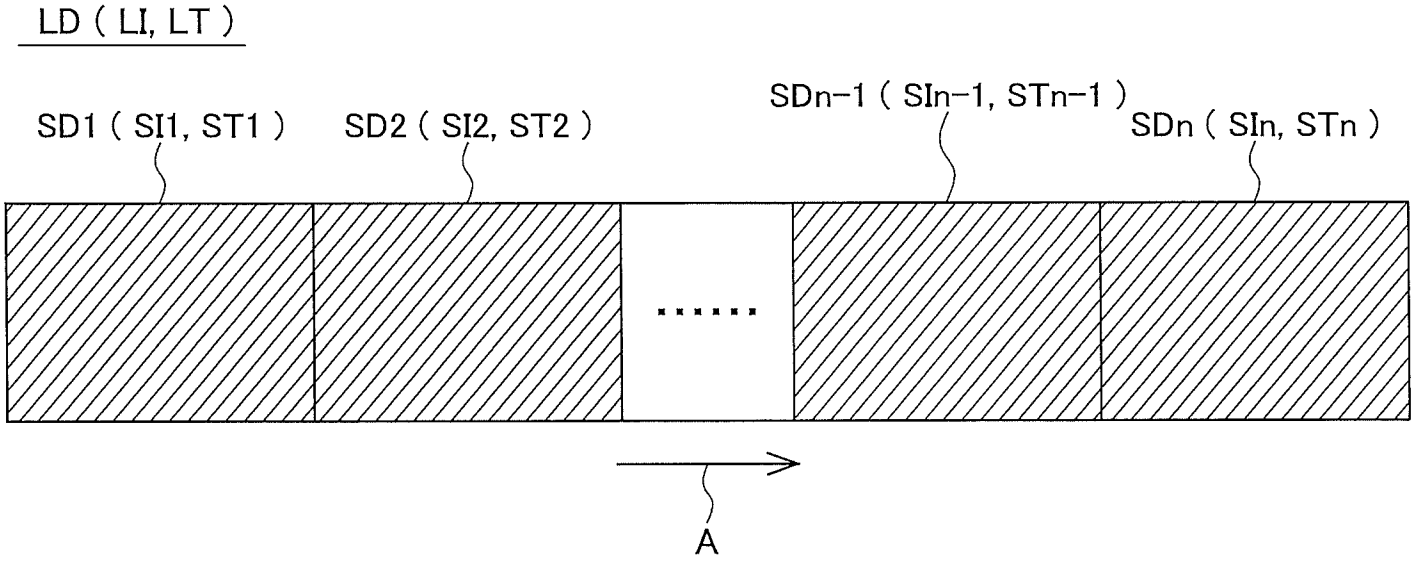
FIG. 4 is a diagram illustrating multiple elementary image data items obtained by dividing long image data.

The print job may include long image data LD as the image data. The long image data LD represent a long image LI. The long image data LD will be referred to as the long image LD. A developer image formed based on the long image LD will be referred to as a long image LT. FIG. 4 illustrates the long images LD, LI, and LT. The long image LD is to be printed on a continuous recording medium, such as a paper web from a roll of paper, longer in the medium conveying direction than recording media of normal size (e.g., A4 size). The long images LD, LI, and LT are long in the sub-scanning direction as compared to image data or an image to be printed on a recording medium of normal size. The sub-scanning direction is indicated by arrow A in FIG. 4. In this example, the long image LI consists of multiple identical elementary images SI1, SI2, . . . , SIn (n is an integer greater than 1) successively arranged in the sub-scanning direction. The elementary images SI1, SI2, . . . , SIn will also be referred to as the elementary images SI. The elementary images SI are, for example, label images.

The data analyzer 23 analyzes the image data included in the print job received by the data receiver 22. If the print job includes the long image LD as the image data, the data analyzer 23 detects the boundaries between each adjacent pair of the elementary images SI and divides the long image LD into multiple elementary image data items SD1, SD2, . . . , SDn. The elementary image data items SD1, SD2, . . . , SDn respectively represent or correspond to the elementary images SI1, SI2, . . . , SIn. The elementary image data items SD1, SD2, . . . , SDn will be referred to as the elementary images SD1, SD2, . . . , SDn. The elementary images SD1, SD2, . . . , SDn will also be referred to as the elementary images SD. Developer images formed based on the elementary images SD1, SD2, . . . , SDn will be referred to as elementary images ST1, ST2, . . . , STn, respectively. The elementary images ST1, ST2, . . . , STn will also be referred to as the elementary images ST.

Further, the data analyzer 23 calculates an actual size (referred to below as the actual print size) of an image obtained by printing the long image LD on a recording medium, and determines, prior to printing, whether density correction needs to be performed during printing depending on whether the actual print size exceeds a predetermined threshold. The print settings included in the print job may include an instruction to perform density correction. In this case, according to the print settings, the data analyzer 23 determines that density correction needs to be performed.

Figure 5:
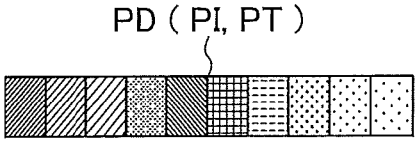
FIG. 5 is a diagram illustrating a configuration of image data of a density correction pattern.

The data editor 24 is a processor that edits data based on the analysis of the image data by the data analyzer 23. The data editor 24 includes a pattern generator 25 and a pattern combiner 26. The pattern generator 25 generates image data (or density correction pattern data) PD of a density correction pattern necessary for density correction. The image data PD represents a pattern image PI. The image data PD will be referred to as the pattern image PD. A developer image formed based on the pattern image PD will be referred to as a pattern image PT. FIG. 5 illustrates the pattern images PD, PI, and PT. The pattern image PI is, for example, an image in which for each developer color, multiple rectangular images with different densities are arranged in the sub-scanning direction. The pattern image PD is image data for performing density correction, and the pattern image PT formed based on the pattern image PD is not to be transferred onto a recording medium. Thus, the image forming apparatus 3 is configured to prevent the pattern image PT from being transferred onto a recording medium.

Figure 6:
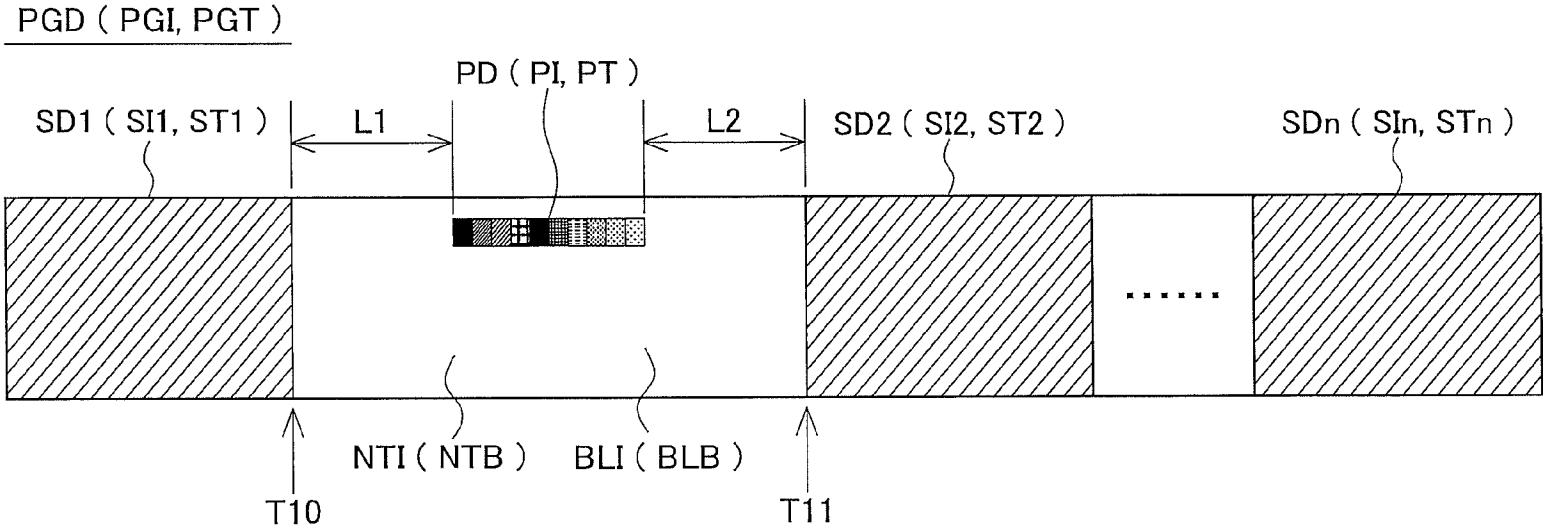
FIG. 6 is a diagram illustrating a configuration of processed image data.

If the data analyzer 23 determines that density correction needs to be performed during printing, the pattern combiner 26 inserts the pattern image PD generated by the pattern generator 25 between adjacent two of the multiple elementary images SD obtained by dividing the long image LD, thereby combining the multiple elementary images SD with the pattern image PD to generate processed image data PGD consisting of the multiple elementary images SD and pattern image PD. The processed image data PGD represent a processed image PGI. The processed image data PGD will be referred to as the processed image PGD. A developer image formed based on the processed image PGD will be referred to as a processed image PGT. FIG. 6 illustrates the processed images PGD, PGI, and PGT. In the example of FIG. 6, the pattern image PD is inserted between elementary images SD1 and SD2.

The processed image PGI has a non-transfer region NTI between the elementary images SI1 and SI2. The non-transfer region NTI includes no image to be transferred onto the recording medium P. The pattern image PI is placed in the non-transfer region NTI after the elementary image SI1 and before the elementary image SI2. A region corresponding to the non-transfer region NTI on the intermediate transfer belt 42 will be referred to as a non-transfer region NTB.

To make it possible to easily distinguish the pattern image PT from the elementary images ST, in the processed image PGD or PGI, the pattern image PD or PI is spaced a first distance L1 from the rear end of the elementary image SD1 or SI1 and spaced a second distance L2 from the front end of the elementary image SD2 or SI2. That is, the processed image PGD is generated so that the pattern image PT is spaced the distance L1 from the rear end of the elementary image ST1 and spaced the distance L2 from the front end of the elementary image ST2. The non-transfer region NTI includes the region of the pattern image PI and the other region, which is colorless or blank and will be referred to as the blank region BLI. A region corresponding to the blank region BLI on the intermediate transfer belt 42 will be referred to as a blank region BLB.

Referring back to FIG. 1, the print processor 21 includes a developing controller 27, a medium conveying controller 28, a transfer controller 29, a fixing controller 30, a transfer separation controller 31, a fixing separation controller 32, an image position detector 33, a pattern detector 34, and a density corrector 35.

The developing controller 27 controls the developing section 40 (FIG. 2) in accordance with the print job. The medium conveying controller 28 controls the conveying unit 41 (FIG. 2) for conveying the recording medium P. The transfer controller 29 controls the intermediate transfer unit 43 (FIG. 2) for conveying, by the intermediate transfer belt 42, developer images transferred on the intermediate transfer belt 42 (FIG. 2) by the developing section 40 and transferring the developer images onto the recording medium P. The fixing controller 30 controls the fixing unit 44 (FIG. 2) for applying heat and pressure to the recording medium P with developer images transferred thereon and thereby fixing the developer images to the recording medium P.

The transfer separation controller 31 controls the transfer separation mechanism 46 (FIG. 2) for separating the intermediate transfer belt 42 and conveying belt 45 from each other and bringing the separated intermediate transfer belt 42 and conveying belt 45 into contact with each other again. The fixing separation controller 32 controls the fixing separation mechanism 49 (FIG. 2) for separating the fixing belt 47 and pressure roller 48 of the fixing unit 44 from each other and bringing the separated fixing belt 47 and pressure roller 48 into contact with each other again.

The image position detector 33 detects boundaries between the elementary images ST and pattern image PT transferred on the intermediate transfer belt 42 based on output from the image position sensor 50, which is disposed facing an outer surface of the intermediate transfer belt 42. In the example of FIG. 6, the image position detector 33 detects a boundary T10 between the elementary image ST1 and the blank region BLB and a boundary T11 between the blank region BLB and the elementary image ST2. The pattern detector 34 determines, as the pattern image PT, a developer image formed after the boundary T10 detected by the image position detector 33, and reads the developer image by the density correction sensor 51, which is disposed facing the outer surface of the intermediate transfer belt 42, to generate read pattern data.

Based on the read pattern data generated by the pattern detector 34, for each color, the density corrector 35 determines a density (referred to as the actual density) of the developer image in the pattern image PT transferred on the intermediate transfer belt 42, compares the determined actual density with an optimum density required for printing, and performs density correction on the developing section 40 so that the actual density approaches the optimum density.

The functions of the data processor 20 and print processor 21 may be implemented by one or more circuits, such as hard-wired circuits or programmable processors. For example, the image forming apparatus 3 includes a memory configured to store instructions or program, and a processor configured to execute the instructions or program to perform the functions.

<2. Printing Operation of Image Forming Apparatus>

The printing operation of the image forming apparatus 3 will be described below. In the printing operation, the image forming apparatus 3 performs a preparation process to prepare image data (or print data) to be printed, and then performs a printing process based on the print data.

Figure 7:
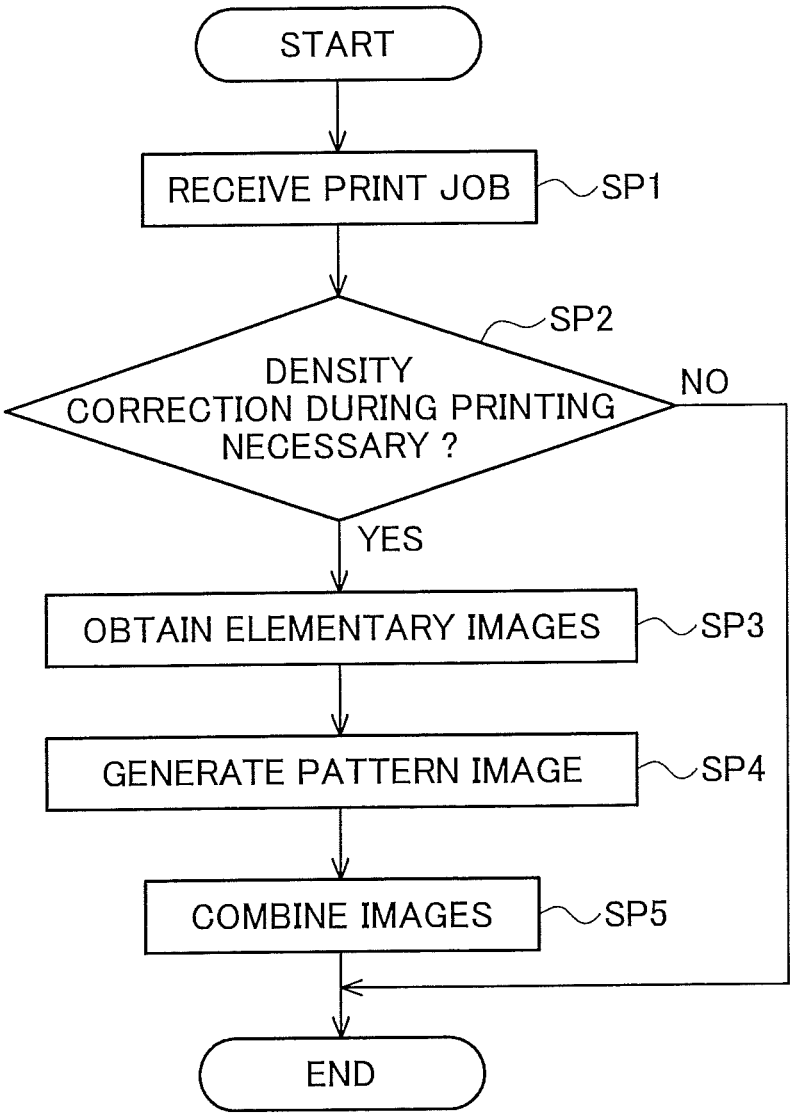
FIG. 7 is a flowchart illustrating a procedure of a process for preparing print data.

The preparation process will be first described with reference to the flowchart illustrated in FIG. 7. The preparation process is performed by the data processor 20 of the image forming apparatus 3.

First, in step SP1, the data receiver 22 of the data processor 20 receives a print job sent from the client PC 2. The print job includes print settings and image data, as described above. Here, it is assumed that the print job includes the long image LD as the image data.

Next, in step SP2, the data analyzer 23 of the data processor 20 analyzes the long image LD included in the print job received by the data receiver 22, divides the long image LD into the elementary images SD, and determines whether density correction needs to be performed during printing, based on the actual print size of the long image LD.

If the data analyzer 23 determines that no density correction need to be performed during printing (NO in step SP2), the data processor 20 determines, as the print data, the long image LD included in the print job, ending the preparation process.

On the other hand, if the data analyzer 23 determines that density correction needs to be performed during printing (YES in step SP2), the data analyzer 23 obtains, in step SP3, the multiple elementary images SD obtained by dividing the long image LD included in the print job, as illustrated in FIG. 4.

Then, in step SP4, the pattern generator 25 of the data processor 20 generates the pattern image PD illustrated in FIG. 5. Then, in step SP5, the pattern combiner 26 of the data processor 20 combines the multiple elementary images SD with the pattern image PD by inserting the pattern image PD between adjacent two (for example, the elementary images SD1 and SD2) of the multiple elementary images SD as illustrated in FIG. 6, thereby generating the processed image PGD. The position in which the pattern image PD is inserted is determined by the data analyzer 23 based on the actual print size of the long image LD.

At this time, the pattern image PD (or PI) is inserted between the elementary images SD1 and SD2 (or SI1 and SI2) so that the pattern image PD (or PI) is spaced the distance L1 from the preceding elementary image SD1 (or SI1) and spaced the distance L2 from the subsequent elementary image SD2 (or SI2). The distances L1 and L2 are set as follows.

The distance L1 is set so that when the rear end of the preceding elementary image ST1 transferred on and conveyed by the intermediate transfer belt 42 reaches the nip position T1 of the intermediate transfer unit 43, transfer of the pattern image PT onto the intermediate transfer belt 42 has not yet been started. That is, the distance L1 is set to be equal to or greater than a distance corresponding to a distance L1*x*, illustrated in FIG. 8, between the nip position T1 of the intermediate transfer belt 42 and a transfer position T2 at which a developer image is transferred from the developing unit 40A, by which the pattern image PT is first transferred, onto the intermediate transfer belt 42. The pattern combiner 26 generates the processed image PGD so that after completion of transfer of the elementary image ST1 onto the recording medium P, transfer of the pattern image PT onto the intermediate transfer belt 42 is started.

Figure 8:
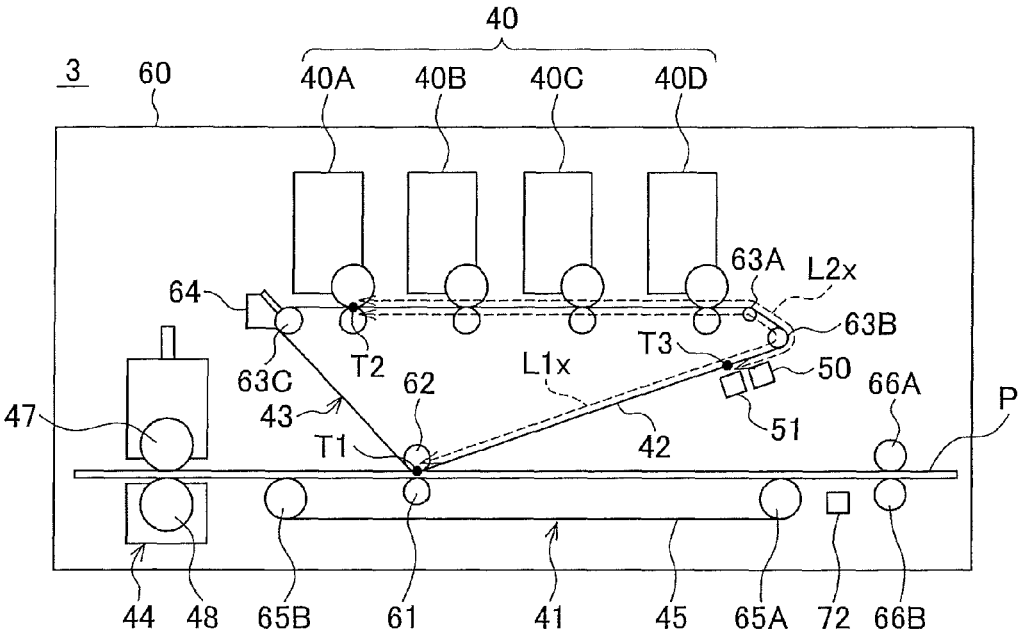
FIG. 8 is a diagram for explaining a distance between a pattern image and a preceding elementary image and a distance between a pattern image and a subsequent elementary image.

The distance L2 is set so that when the rear end of the pattern image PT transferred on and conveyed by the intermediate transfer belt 42 reaches a reading position T3, illustrated in FIG. 8, of the density correction sensor 51, formation of the subsequent elementary image ST2 has not yet been started. That is, the distance L2 is set to be equal to or greater than a distance corresponding to a distance L2*x*, illustrated in FIG. 8, between the reading position T3 of the density correction sensor 51 and the transfer position T2. The pattern combiner 26 generates the processed image PGD so that after completion of detection of the pattern image PT by the density correction sensor 51, formation of the elementary image ST2 is started. The reason why the distances L1 and L2 are set as above will be described later.

As above, if the data analyzer 23 determines that density correction needs to be performed during printing (YES in step SP2), the data processor 20 generates the processed image PGD. Then, the data processor 20 sets the generated processed image PGD as the print data, ending the preparation process.

In this example, the pattern image PD is inserted in one position between the elementary images SD1 and SD2. However, depending on the actual print size, the pattern image PD may be inserted in two or more positions.

Figure 9:
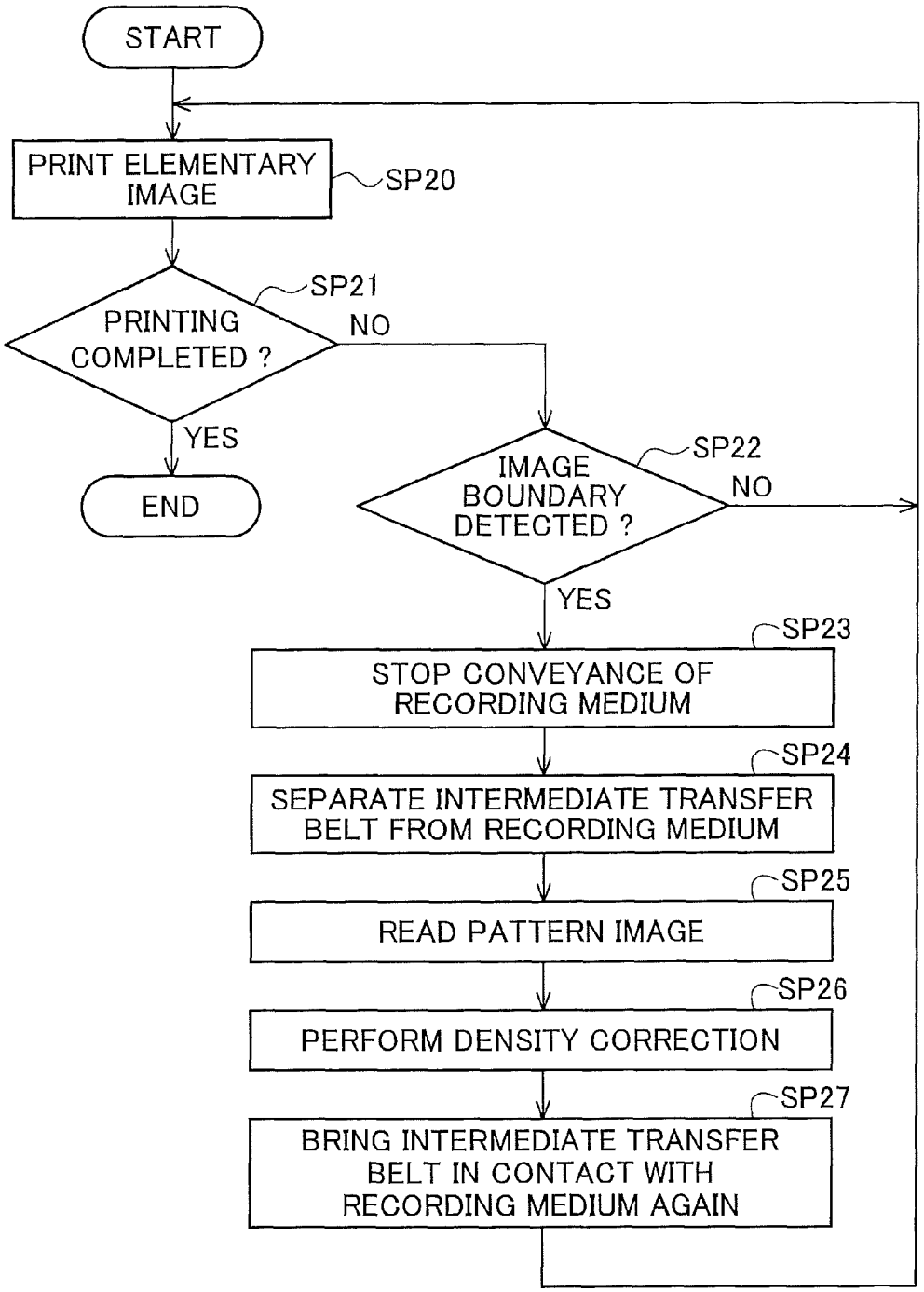
FIG. 9 is a flowchart illustrating a procedure of a printing process.

Next, the printing process to print the print data prepared in the preparation process will be described with reference to the flowchart illustrated in FIG. 9. The printing process is performed by the print processor 21 of the image forming apparatus 3.

First, in step SP20, the print processor 21 performs printing based on the print data. Specifically, the developing controller 27, medium conveying controller 28, transfer controller 29, and fixing controller 30 of the print processor 21 control the printing mechanism 36 to print one of the multiple elementary images SD included in the long image LD or processed image PGD so that the multiple elementary images SD are printed in order.

At this time, the developing section 40 forms developer images of the respective colors based on the elementary image SD and transfers the developer images onto the intermediate transfer belt 42, thereby forming an elementary image ST on the intermediate transfer belt 42. The elementary image ST is conveyed by the intermediate transfer belt 42 to the nip position T1, and transferred onto the recording medium P conveyed by the conveying belt 45 at the nip position T1. The recording medium P passes through the fixing unit 44, so that the transferred elementary image ST is fixed to the recording medium P. As such, the image based on the elementary image SD is printed on the recording medium P.

Next, in step SP21, the print processor 21 determines whether printing of all the elementary images SD included in the long image LD or processed image PGD has been completed. If printing of all the elementary images SD has been completed (YES in step SP21), the print processor 21 ends the print process.

On the other hand, if printing of all the elementary images SD has not been completed (NO in step SP21), the print processor 21 proceeds to step SP22. In step SP22, the image position detector 33 of the print processor 21 determines whether it has detected a boundary between an elementary image ST and the pattern image PT. If no boundary has been detected (NO in step SP22), the print processor 21 returns to step SP20 and prints the subsequent elementary image SD.

On the other hand, if a boundary (e.g., the boundary T10 between the elementary image ST1 and the pattern image PT illustrated in FIG. 6) has been detected (YES in step SP22), the print processor 21 proceeds to step SP23. In step SP23, when the rear end of the elementary image ST1 formed before the boundary T10 reaches the nip position T1 of the intermediate transfer unit 43, the developing controller 27, medium conveying controller 28, and transfer controller 29 stop operation of the developing section 40, conveyance of the recording medium P by the conveying belt 45, and movement of the intermediate transfer belt 42. At this time, transfer of the elementary image ST1 onto the recording medium P has been completed. Since the pattern image PD or PI is spaced the distance L1 from the rear end of the elementary image SD1 or SI1 as described above, no pattern image PT has been transferred onto the intermediate transfer belt 42.

Next, in step SP24, the transfer separation controller 31 drives the transfer separation mechanism 46 to separate the intermediate transfer belt 42 from the recording medium P, as illustrated in FIG. 3. This is to prevent the pattern image PT subsequent to the elementary image ST1 from being transferred onto the recording medium P. Further, at this time, the fixing separation controller 32 drives the fixing separation mechanism 49 to separate the fixing belt 47 from the recording medium P, as illustrated in FIG. 3. As such, in this embodiment, the print processor 21 separates, from the recording medium P, not only the intermediate transfer belt 42 but also the fixing belt 47. This is because if the fixing belt 47 is left in contact with the recording medium P while conveyance of the recording medium P is stopped, the recording medium P may be deformed or damaged by heat.

Next, in step SP25, the developing controller 27 and transfer controller 29 cause the developing section 40 and intermediate transfer belt 42 to operate so that the developing section 40 forms a pattern image PT and transfers the pattern image PT onto the intermediate transfer belt 42. The pattern detector 34 detects and reads the pattern image PT conveyed by the intermediate transfer belt 42 to generate read pattern data. When the rear end of the pattern image PT reaches the reading position T3 of the density correction sensor 51, the reading of the pattern image PT is completed. At this time, since the elementary image SD2 or SI2 subsequent to the pattern image PD or PI is spaced the distance L2 from the rear end of the pattern image PD or PI as described above, no developer image based on the elementary image SD2 has been formed.

Next, in step SP26, based on the read pattern data generated by the pattern detector 34, for each color, the density corrector 35 performs density correction by calculating, as a density correction amount (or value), a difference between the actual density and the optimum density, and applies the correction result (i.e., density correction amount) to the density of a developer image formed by the developing section 40 by notifying the developing controller 27 of the correction result (i.e., density correction amount), so that the density of a developer image formed by the developing section 40 is corrected to the optimum density.

After the density correction, the developing section 40 forms a developer image (elementary image ST2) based on the elementary image SD2 subsequent to the pattern image PD, and transfers the elementary image ST2 onto the intermediate transfer belt 42. Thus, the result of the density correction (or the density correction amount for each color)

is applied to or reflected in the elementary image ST2 and subsequent developer images.

Next, in step SP27, when the front end of the elementary image ST2 subsequent to the pattern image PT reaches the nip position T1 of the intermediate transfer belt 42, the developing controller 27 and transfer controller 29 stop operation of the developing section 40 and movement of the intermediate transfer belt 42. At this time, the pattern image PT transferred on the intermediate transfer belt 42 has passed through the nip position T1 without being transferred onto the recording medium P.

The transfer separation controller 31 drives the transfer separation mechanism 46 to bring the intermediate transfer belt 42 into contact with the recording medium P again, and the fixing separation controller 32 drives the fixing separation mechanism 49 to bring the fixing belt 47 into contact with the recording medium P again. Then, the print processor 21 returns to step SP20 and restarts the printing of the elementary images SD. Thus, the elementary images SD2, SD3, . . . are printed on the recording medium P following the elementary image SD1. Thus, the processed image PGI illustrated in FIG. 6 is printed on the recording medium P except for the non-transfer region NTI including the pattern image PI between the boundaries T10 and T11. That is, only the elementary images SI of the processed image PGI are printed on the recording medium P.

As such, when the print data include the pattern image PD (i.e., the print data are the processed image PGD), the print processor 21 reads the pattern image PT to perform density correction during the printing, and separates the intermediate transfer belt 42 from the recording medium P to prevent the pattern image PT from being printed on the recording medium P.

<3. Advantages>

As described above, when the image forming apparatus 3 prints, on the recording medium P, an image based on the long image LD requiring density correction during printing, it divides the long image LD into the multiple elementary images SD and inserts the pattern image PD between adjacent two of the multiple elementary images SD, thereby generating the processed image PGD.

Then, while the image forming apparatus 3 prints an image based on the processed image PGD on the recording medium P, it transfers the pattern image PT based on the pattern image PD included in the processed image PGD onto the intermediate transfer belt 42 and performs density correction by reading the pattern image PT by the density correction sensor 51. The image forming apparatus 3 (or print processor 21) may correct density of at least one of the elementary images ST subsequent to the elementary image ST1 based on the detection of the pattern image PT by the density correction sensor 51. Further, to prevent the pattern image PT transferred on the intermediate transfer belt 42 from being transferred onto the recording medium P, the image forming apparatus 3 causes the pattern image PT to pass through the nip position T1 of the intermediate transfer unit 43 while the intermediate transfer belt 42 and recording medium P are separated from each other.

The image forming apparatus 3 forms the pattern image PT in a portion facing the recording medium P on the intermediate transfer belt 42 and prevents the pattern image PT from being transferred onto the recording medium P by separating the intermediate transfer belt 42 and the recording medium P from each other when the pattern image PT passes through the nip position T1 of the intermediate transfer unit 43.

Thus, compared to an image forming apparatus that includes an intermediate transfer belt having a width greater than that of a recording medium and forms a pattern image on the intermediate transfer belt 42 in a portion that does not face the recording medium, the image forming apparatus 3 can perform density correction during printing with the intermediate transfer belt 42 having a narrow width. Thus, it is possible to provide an image forming apparatus capable of performing density correction (or forming a density correction pattern image or test pattern image) during printing and small in size as compared to the conventional image forming apparatus.

The image forming apparatus 3 places the pattern image PD (or PI) between the preceding elementary image SD1 (or SI1) and the subsequent elementary image SD2 (or SI2) so that the pattern image PD (or PI) is spaced the distance L1 from the elementary image SD1 (or SI1) and spaced the distance L2 from the elementary image SD2 (or SI2). The distance L1 is set so that when the rear end of the preceding elementary image ST1 reaches the nip position T1 of the intermediate transfer unit 43, transfer of the pattern image PT onto the intermediate transfer belt 42 has not yet been started.

This makes it possible to transfer the pattern image PT onto the intermediate transfer belt 42 after the rear end of the elementary image ST1 reaches the nip position T1 of the intermediate transfer unit 43 and the intermediate transfer belt 42 is separated from the recording medium P. In the image forming apparatus 3, when the intermediate transfer belt 42 is separated from the recording medium P, although the intermediate transfer belt 42 is stopped, movement of the backup roller 62 and belt rollers 63B and 63C may swing the intermediate transfer belt 42 or move the intermediate transfer belt 42 in the conveying direction. Thus, if the intermediate transfer belt 42 and recording medium P are separated from each other in the middle of the transfer of the pattern image PT onto the intermediate transfer belt 42, the pattern image PT may be transferred inaccurately. Inaccurate transfer of the pattern image PT may lead to inaccurate density correction.

The image forming apparatus 3 transfers the pattern image PT onto the intermediate transfer belt 42 after separating the intermediate transfer belt 42 from the recording medium P, so that the image forming apparatus 3 can accurately transfer the pattern image PT onto the intermediate transfer belt 42, resulting in accurate density correction.

The distance L2 is set so that when the rear end of the pattern image PT transferred on and conveyed by the intermediate transfer belt 42 reaches the reading position T3 of the density correction sensor 51, formation of the subsequent elementary image ST2 has not yet been started. This makes it possible to perform density correction based on the read pattern data and apply the result of the density correction to the elementary image ST2 immediately after the pattern image PT.

<4. Modifications>

<4-1. First Modification>

In the above embodiment, the image forming apparatus 3 applies the result of the density correction to one or more elementary images ST subsequent to the pattern image PT. This is not mandatory. The image forming apparatus 3 (or print processor 21) may gradually correct density of a plurality of the at least one elementary image ST subsequent to the elementary image ST1 based on the detection of the pattern image PT by the density correction sensor 51. Specifically, instead of simply applying the density correction amount, which is the difference between the actual density and the optimum density, to the elementary images ST subsequent to the pattern image PT, the image forming apparatus 3 may apply a density correction amount to the elementary images ST subsequent to the pattern image PT while increasing the density correction amount by a given amount (e.g., 5%) per elementary image ST so that the density correction amount finally reaches a target density correction amount, which is the difference between the actual density and the optimum density. Specifically, the image forming apparatus 3 may apply a density correction amount to the elementary images ST subsequent to the pattern image PT while increasing the density correction amount by a given amount in such a manner as to apply 5% of the target density correction amount to the elementary image ST2 subsequent to the pattern image PT, 10% of the target density correction amount to the subsequent elementary image ST3, 15% of the target density correction amount to the subsequent elementary image ST4, . . . .

This can prevent a situation where the density of the elementary image ST1 immediately before the density correction is greatly different from the density of the elementary image ST2 immediately after the density correction, resulting in uncomfortable print images. Also, the image forming apparatus 3 may apply a density correction amount to the elementary images ST subsequent to the pattern image PT while increasing the density correction amount by a given amount only if the target density correction amount, which is the difference between the actual density and the optimum density, exceeds a predetermined threshold (i.e., only if the target density correction amount is great).

<4-2. Second Modification>

In the above embodiment, the pattern image PD (or PI) is placed between the preceding elementary image SD1 (or SI1) and the subsequent elementary image SD2 (or ST2) so that the pattern image PD (or PI) is spaced the distance L1 from the elementary image SD1 (or SI1) and spaced the distance L2 from the elementary image SD2 (or ST2). However, the distances L1 and L2 may be decreased as compared to the above embodiment. Merely to allow the pattern image PT to be distinguished from the preceding and subsequent elementary images ST1 and ST2, it is sufficient to provide blank portions for distinguishing them.

Figure 10:
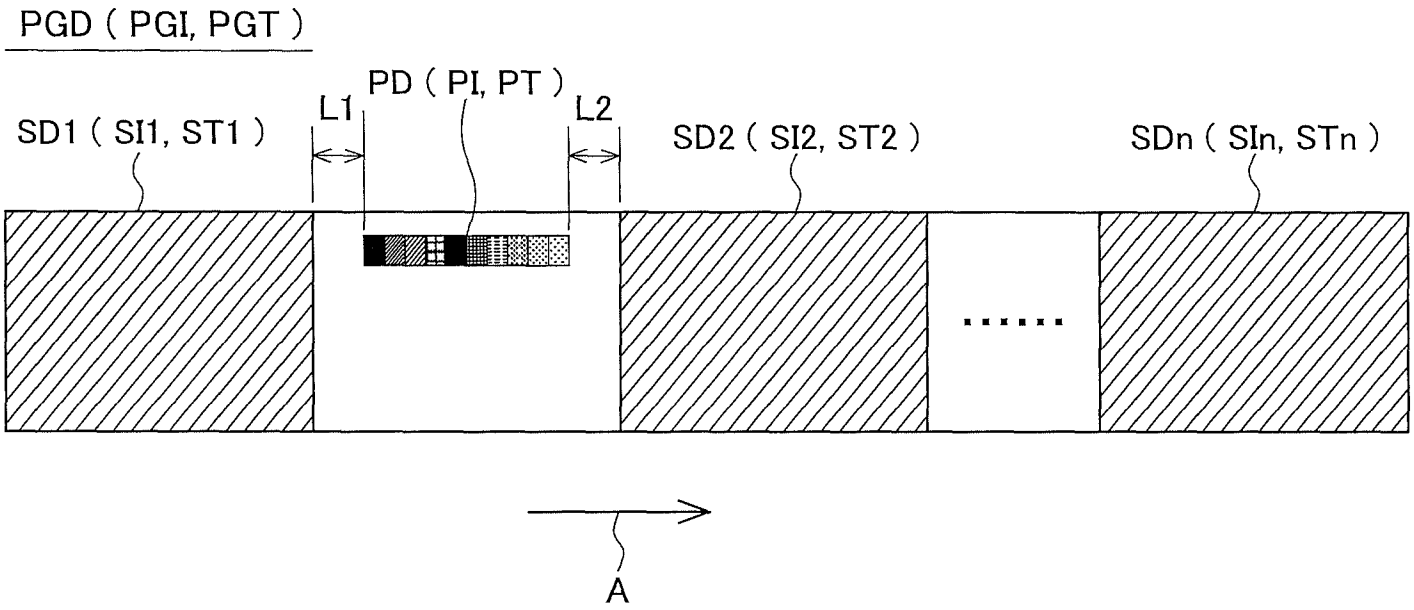
FIG. 10 is a diagram illustrating a configuration of processed image data of a modification.

For example, as illustrated in FIG. 10, the distance L1 between the pattern image PD (or PI) and the preceding elementary image SD1 (or SI1) may be set to a minimum distance required to distinguish the pattern image PT and the preceding elementary image ST1; the distance L2 between the pattern image PD (or PI) and the subsequent elementary image SD2 (or SI2) may be set to a minimum distance required to distinguish the pattern image PT and the subsequent elementary image ST2. This can reduce the length of the processed image PGD (or PGI) in the sub-scanning direction (or medium conveying direction) indicated by arrow A in FIG. 10, thereby reducing print time as compared to the above embodiment.

However, if the distance L1 is too small, the pattern image PI is located shortly after the preceding elementary image SI1, so the intermediate transfer belt 42 may be separated from the recording medium P in a state where the pattern image PT is halfway transferred onto the intermediate transfer belt 42, for example. Thus, when accuracy of density correction is given more priority than reduction in print time, the distance L1 is desirably set to the distance described in the above embodiment. The length of the pattern image PD or PI in the sub-scanning direction (or medium conveying direction) may be set so that when the rear end of the preceding elementary image ST1 reaches the nip position T1 of the intermediate transfer unit 43, transfer of the pattern image PT onto the intermediate transfer belt 42 has been completed. This can prevent a situation where the intermediate transfer belt 42 is separated from the recording medium P in a state where the pattern image PT is halfway transferred onto the intermediate transfer belt 42, and can reduce print time while ensuring accuracy of density correction.

If the distance L2 is too small, the subsequent elementary image SI2 is located shortly after the pattern image PI, so the result of the density correction cannot be applied to the elementary image SI2 subsequent to the pattern image PT and can be applied only to elementary images ST formed after completion of reading of the pattern image PT. Thus, if the result of the density correction should be applied to the elementary image ST2 immediately after the pattern image PT, the distance L2 is desirably set to the distance described in the above embodiment. Also in this case, it is possible to apply a density correction amount to the elementary images ST while increasing the density correction amount by a given amount per image.

<4-3. Third Modification>

In the above embodiment, the image forming apparatus 3 separates the intermediate transfer belt 42 from the recording medium P by moving the backup roller 62 in the direction toward the inside of the intermediate transfer belt 42 and moving the belt rollers 63B and 63C in the directions toward the outside of the intermediate transfer belt 42. However, how to separate the intermediate transfer belt 42 from the recording medium P is not limited to this. For example, the image forming apparatus 3 may move the backup roller 62 in a direction toward the inside of the intermediate transfer belt 42 and move one of the belt rollers 63B and 63C in a direction toward the outside of the intermediate transfer belt 42.

Further, for example, the image forming apparatus 3 may include a transfer separation unit (not illustrated) for moving the entire intermediate transfer unit 43 except for the intermediate transfer roller 61 in a direction (upward direction) away from the conveying belt 45 and intermediate transfer roller 61, and move the entire intermediate transfer unit 43 except for the intermediate transfer roller 61 by the transfer separation unit to separate the intermediate transfer belt 42 from the recording medium P. Since the developing section 40 is disposed above the intermediate transfer unit 43, the transfer separation unit desirably moves the developing section 40 together with the intermediate transfer unit 43 in the same direction.

The image forming apparatus 3 may include a transfer separation unit for moving the conveying unit 41 and intermediate transfer roller 61 in a direction (downward direction) away from the intermediate transfer belt 42 and backup roller 62 without moving the intermediate transfer belt 42, and separate the recording medium P from the intermediate transfer belt 42 by means of this transfer separation unit.

In the above embodiment, the image forming apparatus 3 separates the fixing belt 47 from the recording medium P by moving the fixing belt 47 of the fixing unit 44 in the direction (upward direction) away from the pressure roller 48. However, how to separate the fixing belt 47 from the recording medium P is not limited to this. The image forming apparatus 3 may include a fixing separation unit for moving both the fixing belt 47 and pressure roller 48 away from each other and separate the fixing belt 47 from the recording medium P by means of this fixing separation unit.

Further, for example, when the image forming apparatus 3 includes the transfer separation unit for moving the conveying unit 41 and intermediate transfer roller 61 in the direction (downward direction) away from the intermediate transfer belt 42 and backup roller 62, as described above, the image forming apparatus 3 may include a fixing separation unit for moving the pressure roller 48 in a direction (downward direction) away from the fixing belt 47.

<4-4. Fourth Modification>

In the above embodiment, when the image forming apparatus 3 detects the boundary between the elementary image ST1 and the pattern image PT, it waits until the rear end of the elementary image ST1 preceding the pattern image PT reaches the nip position T1 of the intermediate transfer unit 43; when the rear end reaches the nip position T1, the image forming apparatus 3 stops the printing, separates the intermediate transfer belt 42 from the recording medium P, and separates the fixing belt 47 from the recording medium P.

However, this is not mandatory, and for example, when the rear end of the elementary image ST1 reaches the nip position T1 of the intermediate transfer unit 43, the image forming apparatus 3 may separate the intermediate transfer belt 42 and recording medium P from each other while leaving the fixing belt 47 and recording medium P in contact with each other. At this time, a developer image (referred to as the non-fixed developer image) that has not been fixed exists on the recording medium P between the fixing unit 44 and the nip position T1 of the intermediate transfer unit 43.

After separating the intermediate transfer belt 42 and recording medium P from each other, the image forming apparatus 3 may operate as follows. The image forming apparatus 3 conveys again the recording medium P to fix the non-fixed developer image on the recording medium P by the fixing unit 44. Upon completion of the fixing of the non-fixed developer image, the image forming apparatus 3 stops the conveyance of the recording medium P and separates the fixing belt 47 and recording medium P from each other. After that, the image forming apparatus 3 conveys the recording medium P in the reverse direction back to the former position (i.e., the position where the rear end of the elementary image ST1 transferred on the recording medium P is just below the nip position T1 of the intermediate transfer unit 43) and stops the conveyance of the recording medium P again.

While performing density correction with the intermediate transfer belt 42 and recording medium P separated from each other, the image forming apparatus 3 may fix the non-fixed developer image on the recording medium P by the fixing unit 44. Immediately after the fixing belt 47 is brought into contact with the recording medium P again, the fixing unit 44 may be unable to sufficiently fix developer due to insufficient heating of the recording medium P. By fixing the non-fixed developer image on the recording medium P by the fixing unit 44 before separating the fixing belt 47 from the recording medium P, as described above, the non-fixed developer image on the recording medium P can be fixed appropriately. A developer image transferred onto the recording medium P after the fixing belt 47 is brought into contact with the recording medium P again takes time to reach the fixing unit 44 and thus can be fixed sufficiently.

<4-5. Fifth Modification>

In the above embodiment, the image forming apparatus 3 prints the long image LT on the paper web from a roll of paper as a continuous recording medium. However, the continuous recording medium is not limited to this. The image forming apparatus 3 may continuously or successively convey multiple recording media of normal size (e.g., A4 size) and continuously or successively print images of multiple pages on the multiple recording media. Also, the image forming apparatus 3 may continuously or successively print the same image on a label web (e.g., label paper web) as a continuous recording medium.

Figure 11:
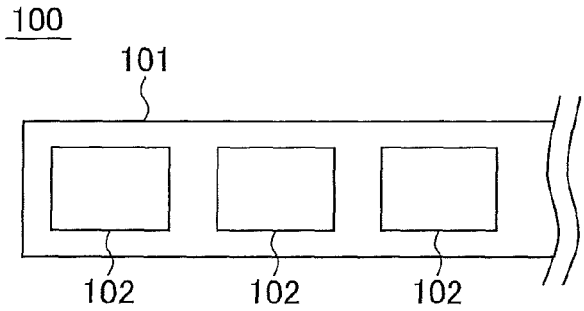
FIG. 11 is a diagram illustrating a configuration of a label web of another modification.

An exemplary case where the image forming apparatus 3 prints on a label web 100 as illustrated in FIG. 11 will be briefly described. The label web (e.g., label paper web) 100 consists of a liner (or backing sheet) 101 and multiple labels (or stickers) 102 arranged on the liner 101 in the medium conveying direction at predetermined intervals. The labels 102 have a predetermined shape (e.g., a rectangular shape). In this case, each of the labels 102 is a print region in which an image is to be printed. For example, the elementary images ST are printed on the labels 102 on a one-to-one basis.

In this case, the image forming apparatus 3 controls the transfer separation mechanism 46 and conveying unit 41 to separate the label web 100 and intermediate transfer belt 42 from each other and bring them into contact with each other again when the nip position T1 of the intermediate transfer unit 43 is located near the middle of a portion (i.e., a non-print region extending in a direction across the medium conveying direction) on the liner 101 between adjacent two labels 102. This makes it possible to prevent an excessive load from being applied to the labels 102 when the intermediate transfer belt 42 and label web 100 are separated from each other and brought into contact with each other again, thereby preventing defects, such as separation of the labels 102. To locate a non-print region between adjacent two labels 102 just below the nip position T1, after detecting a non-print region between adjacent two labels 102 by the medium sensor 72 illustrated in FIG. 2, the image forming apparatus 3 may convey the recording medium P by a predetermined amount (or the distance from the detection position of the medium sensor 72 to the nip position T1).

<4-6. Sixth Modification>

In the above embodiment, the image forming apparatus 3 performs density correction during printing by transferring the pattern image PT, which is an example of a test pattern, onto the intermediate transfer belt 42. However, the image forming apparatus 3 may perform other types of corrections during printing. For example, the image forming apparatus 3 may transfer, onto the intermediate transfer belt 42, position correction patterns for correcting displacement of images transferred onto the intermediate transfer belt 42 and read the position correction patterns to perform displacement correction during printing. To correct the displacement, the image forming apparatus 3 may correct positions of developer images formed on the photosensitive drums 81 of the developing section 40.

<4-7. Seventh Modification>

In the above embodiment, if the actual print size of the long image LD exceeds the predetermined threshold, the image forming apparatus 3 performs density correction during printing of the long image LD. However, the condition for performing density correction during printing is not limited to this, and may be another condition or a combination of multiple conditions.

<4-8. Eighth Modification>

In the above embodiment, the present invention is applied to the image forming apparatus 3 having the configuration illustrated in FIGS. 1 and 2. However, the present invention is applicable to other image forming apparatuses using a secondary transfer system that transfers an image onto an intermediate transfer belt or member and then transfers the image onto a recording medium. Specifically, the present invention is applicable to various image forming apparatuses, such as printers, facsimile machines, or multi-function products (MFPs).

<4-9. Ninth Modification>

In the above embodiment, the image forming apparatus 3 has the intermediate transfer belt 42 as a primary transfer member. However, the primary transfer member is not limited to this, and may be other members on which developer images can be formed (or transferred). Further, in the above embodiment, the image forming apparatus 3 has the developing section 40 as an image forming unit for forming multiple successive developer images on the primary transfer member. However, the image forming unit is not limited to this, and may be other units capable of forming multiple successive developer images on the primary transfer member. Further, in the above embodiment, the image forming apparatus 3 has the developing controller 27 and density corrector 35 as a controller for controlling the developing section 40 as the image forming unit in accordance with the long image LD or processed image PGD as image data and performing density correction. However, the controller is not limited to this, and may be other units capable of controlling the image forming unit and performing density correction.

Further, in the above embodiment, the image forming apparatus 3 has the pattern detector 34 and density correction sensor 51 as a detector for detecting a developer image formed on the primary transfer member. However, the detector is not limited to this, and may be other detectors capable of detecting a developer image formed on the primary transfer member. Further, in the above embodiment, the image forming apparatus 3 has the intermediate transfer roller 61 and backup roller 62 as a secondary transfer unit for transferring a developer image formed on the primary transfer member onto a recording medium. However, the secondary transfer unit is not limited to this, and may be other units capable of transferring a developer image formed on the primary transfer member onto a recording medium.

Further, in the above embodiment, the image forming apparatus 3 has the transfer separation controller 31 and transfer separation mechanism 46 as a transfer separation unit for separating the primary transfer member and the recording medium from each other and bring the primary transfer member and the recording medium into contact with each other. However, the transfer separation unit is not limited to this, and may be other units capable of separating the primary transfer member and the recording medium from each other and bring the primary transfer member and the recording medium into contact with each other. For example, the transfer separation mechanism 46 may use a mechanism other than the solenoid. Further, in the above embodiment, the image forming apparatus 3 has the fixing belt 47 as a heating unit for heating a developer image transferred on a recording medium. However, the heating unit is not limited to this, and may be other units capable of heating a developer image transferred on a recording medium. Further, in the above embodiment, the image forming apparatus 3 has the fixing separation controller 32 and fixing separation mechanism 49 as a fixing separation unit for separating the heating unit and the recording medium from each other and bringing the heating unit and the recording medium into contact with each other. However, the fixing separation unit is not limited to this, and may be other units capable of separating the heating unit and the recording medium from each other and bringing the heating unit and the recording medium into contact with each other. For example, the fixing separation mechanism 49 may use a mechanism other than the solenoid.

<4-10. Tenth Modification>

The present invention is not limited to the above embodiment or modifications. The present invention also covers all possible combinations or subsets of features of the above embodiment and modifications. The present invention can be practiced in various other aspects without departing from the inventive scope.

The present invention can be widely applied to image forming apparatuses having density correction functions.

What is claimed is:

1. An image forming apparatus, comprising:

an image forming unit that forms a test pattern image, and an image corresponding to image data, with developer on a primary transfer member;

a conveying unit that conveys a continuous recording medium to cause the continuous recording medium to face the primary transfer member;

a secondary transfer unit that transfers the image corresponding to the image data formed on the primary transfer member onto the continuous recording medium in contact with the primary transfer member;

a detector that detects the test pattern image formed on the primary transfer member;

a controller that causes the image forming unit to form the test pattern image on the primary transfer member, and causes the image forming unit to form the image corresponding to the image data on the primary transfer member based on a detection of the test pattern image by the detector;

a transfer separation unit that separates the primary transfer member on which the test pattern image is formed and the continuous recording medium from each other;

a heating unit that heats the image corresponding to the image data transferred onto the continuous recording medium, the heating unit being in contact with the continuous recording medium; and a fixing separation unit that separates the heating unit and the continuous recording medium from each other when the primary transfer member and the continuous recording medium are separated from each other by the transfer separation unit, and conveyance of the continuous recording medium facing the primary transfer member by the conveying unit is stopped.

2. The image forming apparatus of claim 1, wherein:

the image corresponding to the image data includes a first image and at least one second image, the controller provides a non-transfer region between the first image and the at least one second image on the primary transfer member and causes the image forming unit to form the test pattern image in the non-transfer region, the non-transfer region being a region in which no image to be transferred onto the continuous recording medium is formed, and when the non-transfer region provided on the primary transfer member comes into contact with the continuous recording medium, the transfer separation unit separates the primary transfer member and the continuous recording medium from each other to prevent the test pattern image from coming into contact with the continuous recording medium.

3. The image forming apparatus of claim 1, wherein the controller causes the image forming unit to form the test pattern image if a predetermined condition is satisfied.

4. The image forming apparatus of claim 1, wherein:

the test pattern image is a density correction pattern image for correcting density of the image formed by the image forming unit, and the controller performs density correction based on the detection of the density correction pattern image by the detector and applies a result of the density correction to the image corresponding to the image data.

5. The image forming apparatus of claim 4, wherein the controller applies the result of the density correction to at least a part of the image corresponding to the image data formed on the primary transfer member after the density correction.

6. The image forming apparatus of claim 4, wherein:

the image corresponding to the image data includes a plurality of successive images including a first image and at least one second image subsequent to the first image, the image forming apparatus further comprises a data editor that divides the image data into a plurality of successive image data items including a first image data item and at least one second image data item, and generates processed image data including the plurality of successive image data items and density correction pattern data placed between the first image data item and the at least one second image data item, the plurality of successive image data items corresponding to the plurality of successive images, the first image data item corresponding to the first image, the at least one second image data item corresponding to the at least one second image, the density correction pattern data corresponding to the density correction pattern image, and the controller causes the image forming unit to form the plurality of successive images and the density correction pattern image on the primary transfer member in accordance with the processed image data, the density correction pattern image being formed between the first image and the at least one second image.

7. The image forming apparatus of claim 6, wherein the data editor spaces the first image data item and the density correction pattern data from each other and spaces the density correction pattern data and the at least one second image data item from each other.

8. The image forming apparatus of claim 6, wherein the data editor spaces the first image data item and the density correction pattern data from each other so that when transfer of the first image onto the recording medium is completed, formation of the density correction pattern image on the primary transfer member has not been started.

9. The image forming apparatus of claim 6, wherein the data editor spaces the density correction pattern data and the at least one second image data item from each other so that when detection of the density correction pattern image by the detector is completed, formation of the at least one second image has not been started.

10. The image forming apparatus of claim 1, wherein:

the recording medium includes a non-print region extending in a direction across a direction in which the recording medium is conveyed, the non-print region being a region in which no image is to be printed, and the transfer separation unit separates the primary transfer member and the recording medium from each other when the non-print region of the recording medium and the primary transfer member are in contact with each other.

11. The image forming apparatus of claim 1, wherein when the primary transfer member and the continuous recording medium are separated from each other by the transfer separation unit, after the heating unit fixes a part of the image corresponding to the image data transferred onto the continuous recording medium, the conveying unit stops conveying the continuous recording medium facing the primary transfer member and the fixing separation unit separates the heating unit and the continuous recording medium from each other.

12. The image forming apparatus of claim 11, wherein after the fixing separation unit separates the heating unit and the continuous recording medium from each other, the conveying unit conveys the continuous recording medium in a direction from the heating unit toward the secondary transfer unit.

13. An image forming apparatus, comprising:

an image forming unit that forms a test pattern image, and an image corresponding to image data, with developer on a primary transfer member, wherein the image data includes data for forming a first image and a plurality of second images subsequent to the first image;

a conveying unit that conveys a continuous recording medium to cause the continuous recording medium to face the primary transfer member;

a secondary transfer unit that transfers the image corresponding to the image data formed on the primary transfer member onto the continuous recording medium in contact with the primary transfer member;

a detector that detects the test pattern image formed on the primary transfer member;

a controller that causes the image forming unit to form the test pattern image on the primary transfer member, and causes the image forming unit to form the plurality of second images on the primary transfer member based on a detection of the test pattern image by the detector; and a transfer separation unit that separates the primary transfer member on which the test pattern image is formed and the continuous recording medium from each other, wherein the test pattern image is a density correction pattern image for correcting density of the image formed by the image forming unit, and the controller obtains a target density correction amount using the detection of the test pattern image by the detector and applies a density correction amount to the plurality of the second images while increasing the density correction amount by a given amount per image, the density correction amount being maintained at the target density correction amount after reaching the target density correction amount.

14. An image forming apparatus, comprising:

an image forming unit that forms a test pattern image, and an image corresponding to image data, with developer on a belt;

a conveying unit that conveys a recording medium to cause the recording medium to face the belt;

a transfer unit that transfers the image corresponding to the image data formed on the belt onto the recording medium in contact with the belt;

a detector that detects the test pattern image formed on the belt;

a controller that causes the image forming unit to form the test pattern image on the belt and causes the image forming unit to form the image corresponding to the image data on the belt based on the detection of the test pattern image by the detector;

a transfer separation unit that separates the belt on which the test pattern image is formed and the recording medium from each other;

a heating unit that heats the image corresponding to the image data transferred onto the recording medium, the heating unit being in contact with the recording medium; and a fixing separation unit that separates the heating unit and the recording medium from each other when the belt and the recording medium are separated from each other by the transfer separation unit, and conveyance of the recording medium facing the belt by the conveying unit is stopped.

15. The image forming apparatus of claim 14, wherein:

the image data includes data for forming a first image and a plurality of second images subsequent to the first image, and the controller obtains a target density correction amount using the detection of the test pattern image by the detector and applies a density correction amount to the plurality of second images while increasing the density correction amount by a given amount per image, the density correction amount being maintained at the target density correction amount after reaching the target density correction amount.

* * * * *